United States Patent [19]

Costabile et al.

[11] Patent Number: 4,566,855

[45] Date of Patent: Jan. 28, 1986

[54] SHOCK ABSORBING CLUTCH ASSEMBLY FOR MARINE PROPELLER

[76] Inventors: John J. Costabile, 7037 E. Moreland, Scottsdale, Ariz. 85257; Arvid B. Costabile, 2716 E. Forrest Cir., Tempe, Ariz. 85281; Ernest Costabile, 1833 E. Carven Rd., Tempe, Ariz. 85284

[21] Appl. No.: 554,842

[22] Filed: Nov. 23, 1983

Related U.S. Application Data

[63] Continuation-in-part of Ser. No. 297,343, Aug. 28, 1981, Pat. No. 4,417,852.

[51] Int. Cl.[4] ..... B63H 1/20

[52] U.S. Cl. ..... 416/134 R; 416/93 A; 416/169 R

[58] Field of Search ..... 416/134 R, 2, 169 R, 416/93 A, 93 M; 464/83, 85, 89, 91, 92

[56] References Cited

U.S. PATENT DOCUMENTS

| | | | |
|---|---|---|---|
| 1,142,916 | 6/1915 | Scott | 416/2 |
| 2,125,270 | 8/1938 | Conover | 416/134 R X |
| 2,164,485 | 7/1939 | Yantis | 416/134 R X |
| 2,235,605 | 3/1941 | Bugatti | 416/134 R |
| 2,363,469 | 11/1944 | Goldschmidt | 464/89 X |
| 2,539,630 | 1/1951 | Krueger et al. | 464/89 X |
| 2,564,826 | 8/1951 | Yoder | 464/89 X |
| 2,948,252 | 8/1960 | Alexander | 416/93 A |
| 3,256,939 | 6/1966 | Novak | 416/134 R X |
| 3,307,634 | 3/1967 | Bihlmire | 416/134 R X |
| 3,477,794 | 11/1969 | Abbott et al. | 416/134 R |
| 3,563,670 | 2/1971 | Knuth | 416/134 R X |
| 3,744,927 | 7/1973 | Bernaerts | 416/2 |
| 3,748,061 | 7/1973 | Henrich | 416/134 R X |
| 3,764,228 | 10/1973 | Shook | 416/134 R X |
| 3,871,324 | 3/1975 | Snyder | 416/134 R X |
| 4,417,852 | 11/1983 | Costabile et al. | 416/134 R X |
| 4,452,591 | 6/1984 | Fishbaugh et al. | 464/89 |

FOREIGN PATENT DOCUMENTS

| | | | |
|---|---|---|---|
| 448071 | 4/1948 | Canada | 416/134 |
| 624166 | 7/1961 | Canada | 416/2 |
| 2439607 | 2/1976 | Fed. Rep. of Germany | 416/2 |
| 704497 | 2/1954 | United Kingdom | 464/83 |

*Primary Examiner*—Everette A. Powell, Jr.

*Attorney, Agent, or Firm*—Cahill, Sutton & Thomas

[57] ABSTRACT

A marine propeller hub has an axial hole therein having a wavy, non-cylindrical surface consisting of a plurality of alternating peaks and valleys. A closely fitting resilient insert slips into the axial hub hole of the propeller hub and has an outer surface with peaks that extend into the respective valleys of the axial hub hole. The resilient insert has a cylindrical axial hole therein with a plurality of longitudinal keyways disposed in the surface of that hole. The keyways receive respective keys rigidly attached to the outer surface of a spline driver adaptor sleeve, the inner surface of which has keyways that receive the splines of a drive shaft of a marine motor. The resilient insert transfers torque from the driving shaft to the hub without slippage if the torque is less than a predetermined amount, and absorbs shock if the propeller strikes a rock or the like by allowing the peaks of the hub hole to compress the peaks of the resilient insert. The resilient insert allows slipping of the hub relative to the driving shaft if the torque on the drive shaft exceeds a predetermined amount of torque.

8 Claims, 12 Drawing Figures

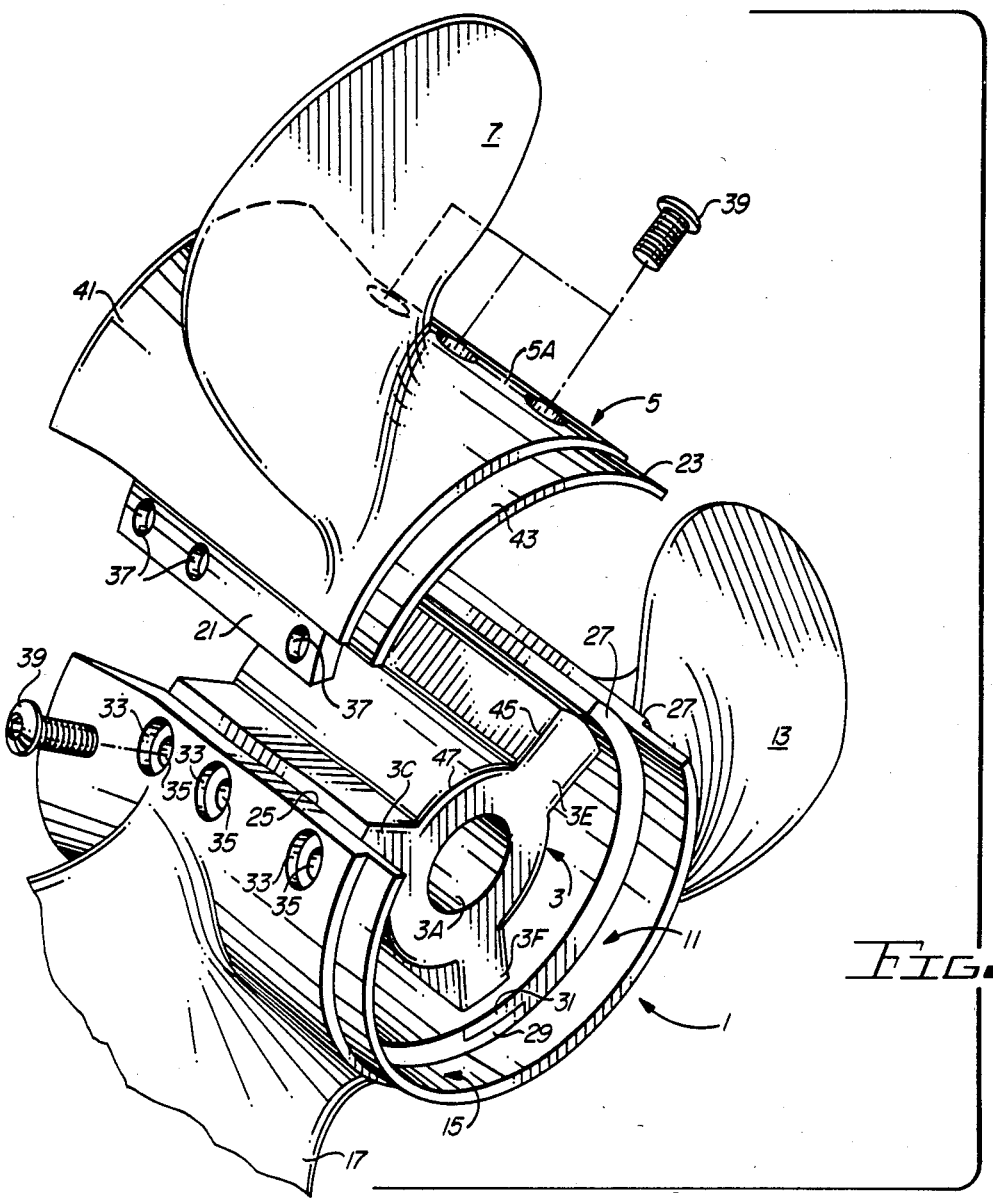
FIG-1
FIG-2
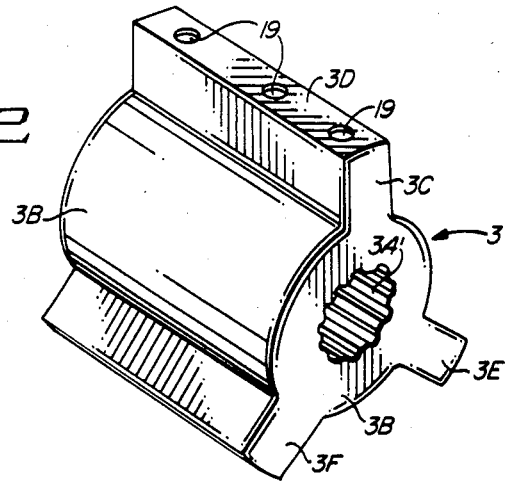

SHOCK ABSORBING CLUTCH ASSEMBLY FOR MARINE PROPELLER

CROSS-REFERENCE TO RELATED APPLICATIONS

This is a continuation-in-part of our pending application entitled "MARINE PROPELLER WITH REPLACEABLE BLADE SECTIONS", Ser. No. 297,343 filed Aug. 28, 1981, now U.S. Pat. No. 4,417,852.

BACKGROUND OF THE INVENTION

The invention relates to marine propellers, particularly to marine propellers having a plurality of replaceable blade sections.

Although a variety of replaceable blade propeller assemblies have been proposed, including those shown in U.S. Pat. Nos. 3,764,228, 3,073,395 and 1,010,929, such multiple piece propeller assemblies have not found widespread acceptance, and single piece propellers are presently used on the vast majority of boats. Use of single piece propellers continues despite the numerous advantages that a practical, reliable, low cost piece propeller assembly with replaceable blade sections would have. For example, one piece propellers usually have to be replaced if they strike heavy, solid objects that severely bend one blade of the propeller during operation of the boat. One piece hub and propeller assemblies are very bulky, and require a large amount of storage space in a boat. Furthermore, propeller blades of different pitches are preferable for various types of boat operation. Therefore, it would be advantages for a boat owner to be able to easily and conveniently change blade pitches for different types of operation, such as pulling skiers or high speed cruising. Many single piece propeller assemblies include through-the-propeller exhaust systems having a plurality of passages in the central portions of the hub through which exhaust gases can escape without interferring with flow of water around the propeller blades during normal boat operation. U.S. Pat. No. 3,876,331 discloses a three-piece marine propeller assembly having removable blade sections and exhaust gas passages through the hub portion thereof. However, none of the three-piece replaceable blade propeller assemblies mentioned above have found wide-spread acceptance because of their complexity. All of them have been implemented by means of inherently flimsy mortise and tenon or collar arrangements for connecting the opposed flanges of the blade support sections to a main hub. Besides being inherently rather flimsy, the proposed devices have been unduly expensive because the main components have been required to be precisely machined to a great extent to provide close tolerance required by the type of construction required by the design of the prior replaceable blade propeller assemblies.

Despite the variety of proposed replaceable blade propeller assemblies that have been introduced, there remains a need for a low cost, highly reliable, easily replaceable multiple piece replaceable blade propeller assembly that is substantially more satisfactory to the boating public than in the device yet proposed.

Accordingly, it is an object of this invention to provide a low cost, highly durable, easily installable replaceable blade marine propeller system that is significantly less complex in design than those of the above-mentioned prior art.

Many commonly used marine propellers utilize rubber shock absorption devices in their hub assemblies to reduce shock transmitted from a propeller blade that strikes an obstacle to the drive train or motor of the boat to reduce damage thereto. Provision of such rubber shock absorbing devices adds to the complexity of its construction and expense of marine propellers, especially those having through-the-propeller exhaust passages, which are highly desirable in order to achieve efficient propeller operation and avoid cavitation under high performance operating conditions.

FIG. 8 illustrates such a prior art device, which can typically be a propeller manufactured by Mercury and other companies. Reference numeral 69 designates one of the above-mentioned rubber shock absorption devices, and consists of a rubber or other resilient cylindrical sleeve that is very tightly pressed (displacing at least a quarter of an inch of rubber) into hole 70 of the hub 71 of marine propeller 72. The rubber sleeve is thermally bonded onto the outer cylindrical surface of an adaptor 74, which is usually composed of brass or steel. Adaptor 74 has an axial cylindrical hole 75 therein with a plurality of horizontal keyways disposed in its wall for receiving the respective splines 76 of the drive shaft 77 of a marine motor.

Typically a hydraulic press is used to apply a great deal of pressure to force the shock mount 69 into hub hole 70. This type of shock mount has a number of disadvantages, the main one being that sometimes a "hot bonded" interface between the rubber sleeve and the spline driver breaks under stress. The propeller then must be repaired, and this repair must be done in a shop with proper equipment, and cannot possibly be done by the owner of a pleasure boat. If the owner did not have a spare propeller, he would have to "limp" back to a landing site and discontinue his boating activity until a spare propeller could be obtained. Furthermore, occasionally when a propeller driven by a large, high powered marine engine strikes a large rock or the like, the above-mentioned prior art rubber shock mounts do not sufficiently isolate the drive train from the resulting shock. Consequently, expensive out-drive mechanisms and marine motors are sometimes damaged.

Accordingly, it is another object of the invention to provide a shock mount coupling means between a drive shaft and a hub, which shock mount coupling means can be easily and inexpensively repaired or replaced without use of specialized equipment such as a hydraulic press or device for bonding a resilient sleeve to a splined driver.

It is another object of the invention to provide a means for shock mount coupling a marine propeller hub to a drive shaft to isolate a drive train connected to the hub from shock imparted to the propeller more effectively than prior art shock mount coupling devices.

SUMMARY OF THE INVENTION

Briefly described and in accordance with one embodiment thereof, the invention provides a marine propeller including a central hub for receiving a motor driven shaft, a plurality of blade support members that are rigidly but removably attached to the hub, and attaching devices for removably attaching the respective blade support members from the hub, wherein each of the blade support members has a propeller blade attached thereto, and includes an inner lip and an outer lip, the outer lip of each blade support member adjoining and overlapping the inner lip of an adjacent blade support member, the attaching devices pushing the outer lip of each blade support member tightly toward the hub, thereby so forcing the overlapped and adjoined inner lips against the hub and rigidly attaching each blade support member to the hub.

In this described embodiment of the invention, the hub includes a cylindrical central portion for receiving the motor driven shaft and three uniformly spaced spoke members extending radially outward from the cylindrical central portion. The inner lips of the respective blade support sections adjoin the respective outer end portions of the three spoke members. A plurality of cap screws extend through aligned holes in the adjoining outer and inner lips and engage threaded holes in the outer end portions of the respective spoke members. The spaces between the radial spoke members form passages for exhaust gases, which pass from the front of the propeller out the rear of the propeller during boat operation. In one described embodiment of the invention, a propeller blade is integrally formed with each of the blade support sections, and the inner and outer lips and also an outwardly flared skirt flange are also integrally formed with each blade support section. When the three blade support sections are rigidly attached to the hub, the three blade support sections form a cylindrical sleeve about the hub.

In one embodiment of the invention, the weakened portion having a groove therein is provided in the base portion of each propeller blade to provide a break-away blade that will break free of the blade support sections if that propeller blade strikes an obstacle during boat operation, thereby avoiding excessive shock from being transmitted to the drive train or motor of the boat and preventing damage thereto.

In another embodiment of the invention, each propeller blade includes separate base and main portions that have respectively adjoining and mating overlapping tongue and groove sections, and are held together by a plurality of cap screws. Propeller blades can then be removed and replaced by removing those cap screws and fastening new propeller blades onto the original bases.

In another embodiment of the invention, a shock mount coupling device is provided for coupling torque from a driving shaft to a hub that is coaxially aligned with a driving shaft wherein a hole is provided in the hub having a smooth, wavy inner wall with successive peaks and valleys therein, a resilient coupling sleeve disposed snugly in the hole of the hub and also having on its outer surface alternating peaks and valleys which are complementary to those in the hub hole. A splined driver having a plurality of rigidly attached keys extends into a hole extending through the resilient coupling sleeve. The keys of the splined driver extend into respective keys disposed in the wall of the hole through the resilient sleeve. The durometer parameter of the resilient sleeve is selected so that the sleeve transfers torque from the driving shaft to the hub without slippage if the torque is less than a predetermined amount, and absorbs shock applied to the hub by allowing the peaks to move against and compress the peaks of the resilient sleeve but allows slippage of the hub relative to the driving shaft if the torque exceeds the predetermined amount. The resilient sleeve can be inserted into the hole in the hub by hand, and the splined driver can be inserted into the hole through the resilient sleeve by hand, allowing on-site replacement of the resilient sleeve while the boat is in the water, without use of specialized tools.

BRIEF DESCRIPTION OF THE DRAWINGS

FIG. 1 is a partial exploded view of one embodiment of the invention.

FIG. 2 is a perspective view of the hub of the replaceable blade propeller of FIG. 1.

DESCRIPTION OF THE INVENTION

Figure 3:
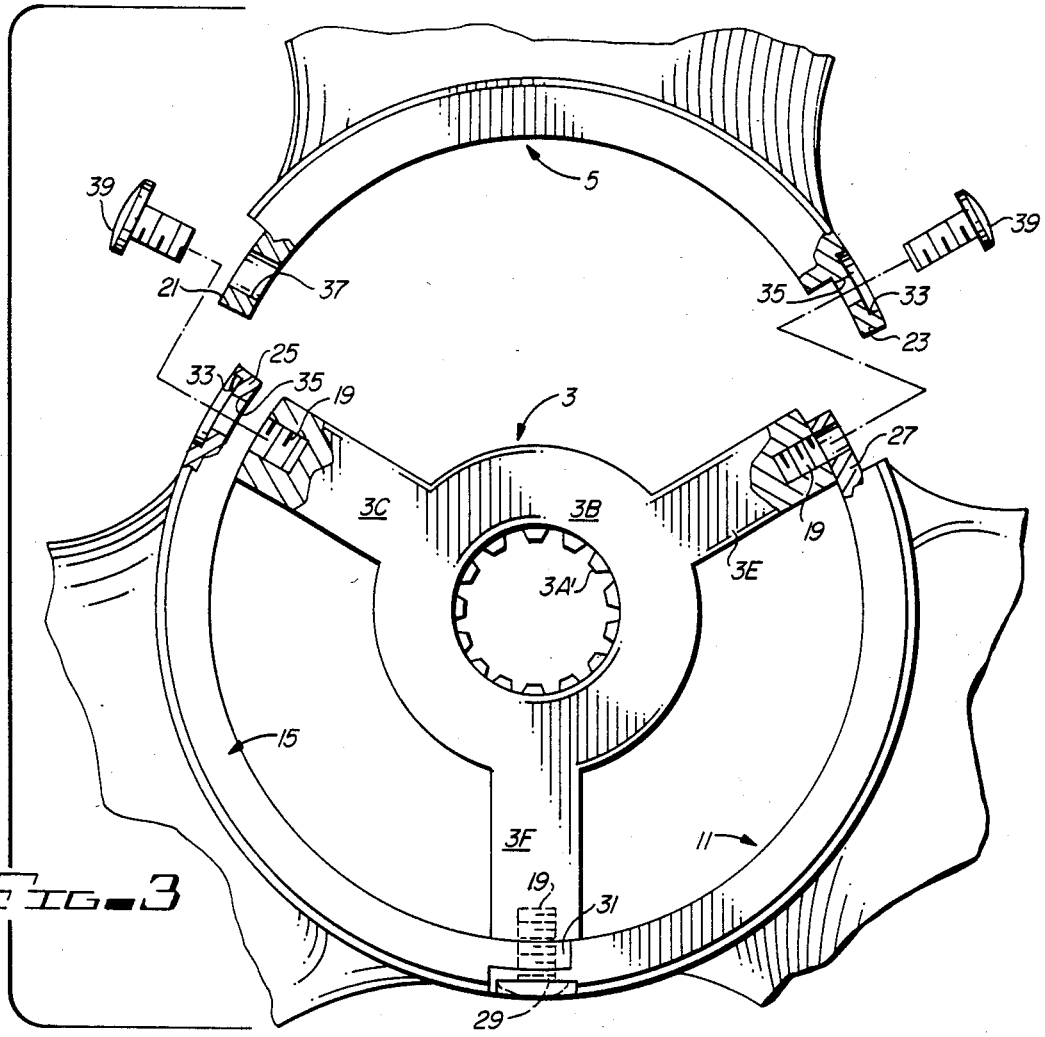
FIG. 3 is a partial sectional view of the replaceable blade propeller shown in FIG. 1.
Figure 4:
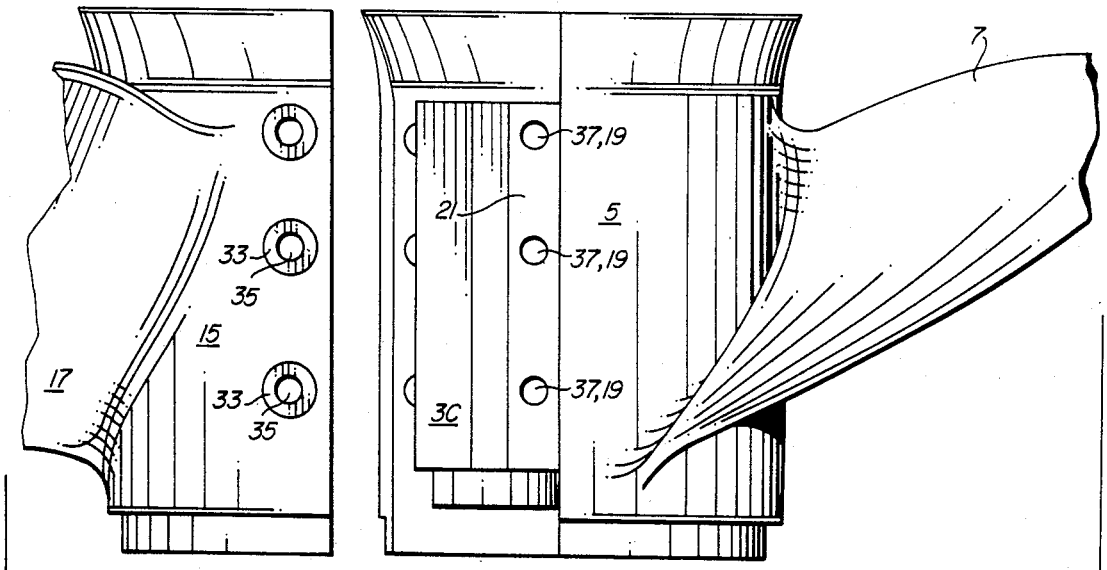
FIG. 4 is a partial top view of the propeller of FIG. 1 with one blade support section moved aside.

Referring now to the drawings, particularly FIGS. 1–4, replaceable blade propeller assembly 1 includes a hub 3 and three replaceable blade sections 5, 11 and 15 that support propeller blades 7, 13, and 17, respectively.

Referring particularly to FIGS. 1 and 2, hub 3 (which is shown reversed end to end in FIG. 2) includes a cylindrical center portion 3B having an axial hole 3A therein for receiving a motor driven shaft. The rear end of hole 3A has a plurality of spline teeth 3A' for engaging mating teeth of a typical motor driven shaft. Three spoke members 3C, 3E, and 3F extend radially outward from cylindrical portion 3B of hub 3. Each of spoke members 3C, 3E, and 3F is integral with hub section 3B, is rectangular in configuration, and includes a rounded outer surface such as 3D having a radius of curvature that extends to the center axis of cylindrical portion 3B.

Each of replaceable blade sections 5, 11, and 15 are identical, and only blade section 5 will be described in detail.

Replaceable blade section 5 includes a blade support section 5A that has the general configuration of a third of a cylinder. Its leading edge has a shoulder 43 which, in combination with the similar shoulders of the remaining two replaceable blade sections forms a cylindrical band of reduced diameter for communicating with a recess in the housing of a typical propeller shaft for preventing escape of exhaust gases around the leading of the propeller and causing exhaust gases to flow through the passages formed by the spaced between spoke members 3C, 3E, and 3F.

The left edge of blade support section 5A includes an inner lip 21 having three holes 37 therein. The right-hand edge of blade support 5A includes an outer lip 23 having a plurality of holes 35 therein, each of holes 35 having an outer increased diameter shoulder 33 for retaining the head of a cap screw 39.

Similarly, blade support section 15 has an outer lip 25 and an inner lip 31. Blade support section 11 has an outer lip 29 and an inner lip 27.

Each outer lip adjoins and overlaps the inner lip of an adjacent one of the blade support sections. The holes 37 of each inner lip are aligned with the spaced holes 19 located across the outer surface of a respective one of the spoke members 3C, 3E, or 3F against which that lip member is adjoined. The holes 37 of each lip are also aligned with the holes 35 of the overlapping outer lip of an adjacent blade support section.

Each of cap screws 39 passes through one of holes 35 of an outer lip, an aligned hole 37 of an inner lip, and engages the threads of a hole 19 in one of spoke members 3C, 3E, or 3F. The head of each cap screw 39 is retained by the corresponding shoulder 33.

Thus, it can be seen that when all of the cap screws 39 are in place, the three replaceable blade sections 5, 11 and 15 form a continuous cylinder attached to hub 3 supporting the three propeller blades 7, 13 and 17, respectively, to provide a single marine propeller unit.

Note that the edges such as 45 and 47 of hub 3 are rounded to provide smooth and efficient flow of pressurized exhaust gases around spoke members 3C, 3E, etc. and through the above-mentioned passages to the rear of propeller 1.

Preferably, hub 3 is formed of hard, high quality stainless steel. Replaceable blade sections 7 can be unitary devices cast from suitable aluminum or aluminum alloy materials, plastic or stainless steel materials, or the like.

Figure 5:
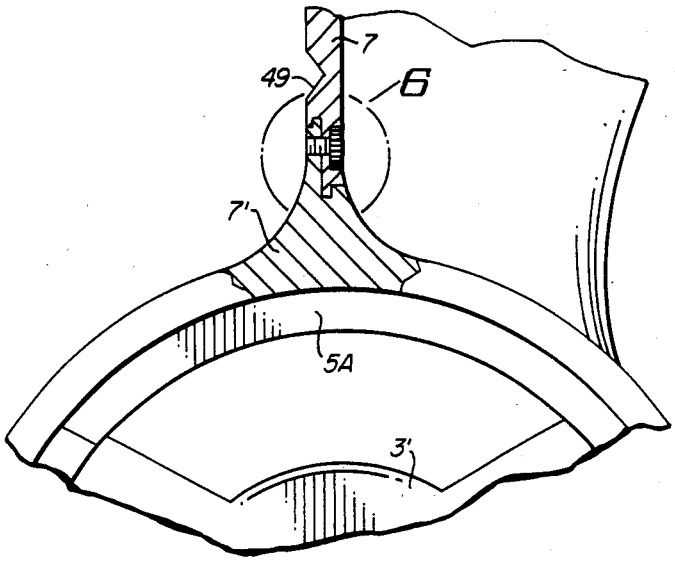
FIG. 5 is a sectional view of an alternate embodiment of the invention.

Referring now to FIG. 5, in an alternate embodiment of the invention, each of the propeller blades, such as 7, include a base portion 7' attached to the outer surface of blade support section, such as 5A. Best shown in FIG. 6, which is an enlarged view of detail 6 of FIG. 5, base section 7' includes a lip section 51 that has a interior narrowed upper end 51A. Upper section of blade 7 includes a groove 60 that receives narrowed portion 51A of lip 51. The upper portion of blade 7 includes a lip 55 that has a interior narrowed portion 55A that fits snugly in a slot 62 of base portion 7'. The surfaces of lips 51 and 55 are precisely flat, so that the corresponding lip and groove portions of base section 7' and the upper portion of blade 7 fits snugly in a tongue-and-groove relationship. A hole 57 through lip section 51 and a hole 59 through lip section 55 are aligned when the upper section of blade 7 is snugly mated with base section 7' thereof. A cap screw 61 extends through clearance hole 59 and engages threads of hole 57, and is flush with the left surface of lip 51 when cap screw 61 is tightened.

Figure 6:
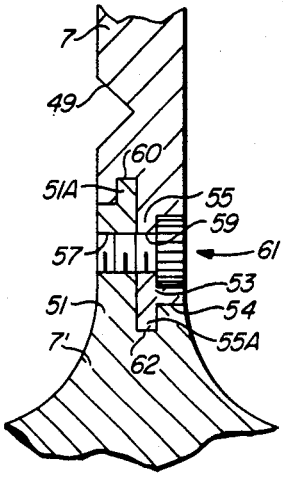
FIG. 6 is an enlarged view of detail 6 of FIG. 5.
Figure 7:
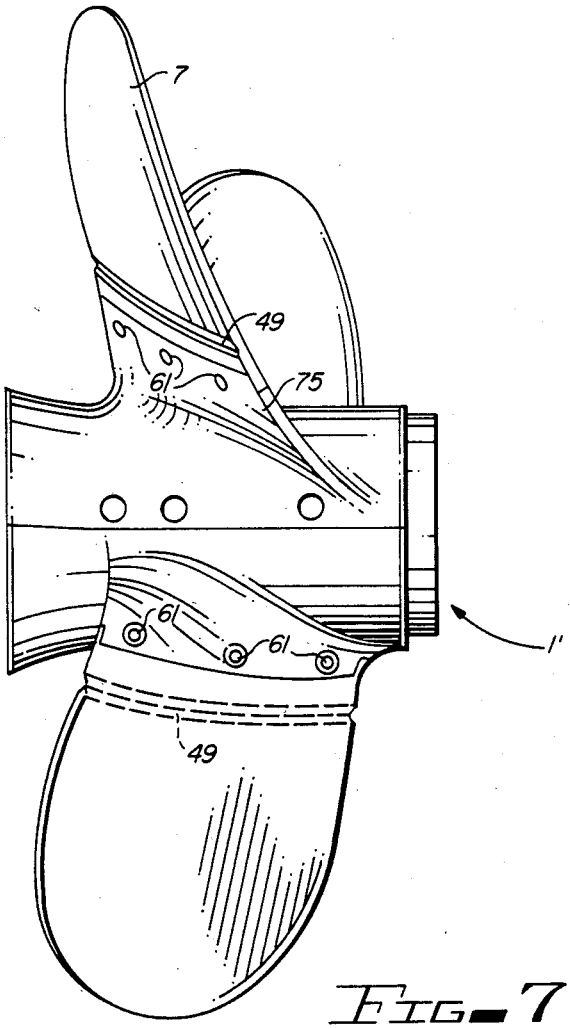
FIG. 7 is a side view of an embodiment of the invention shown in FIG. 5.

In this embodiment of the invention, a groove 49 disposed above the connecting means shown in FIG. 6 is provided along the width of each propeller blade, such as 7, as better seen in FIG. 7. This groove results in a weakened section near the base of blade 7, so that the main portion of blade 7 will break away from the base portion 7' thereof if the main portion hits an obstruction during operation of the boat. This will prevent excessive shock from being transmitted through the propeller shaft to the drive train or motor of the boat, and thereby will prevent damage to the drive train or motor. The broken main blade section 7 can then be removed and replaced by removing the cap screws 61 and reinstalling a spare blade. Of course, different pitched blades can be easily installed.

In FIG. 7, the arrangement of FIG. 5 is shown on a conventional single piece hub and blade support section, wherein the base support sections are separately removable.

The above described embodiments of the invention provide a low cost, highly rigid and durable, and greatly simplified replaceable blade marine propeller that overcomes the previously mentioned disadvantages of prior art replaceable blade marine propellers. In the embodiments of the invention shown in FIGS. 5 through 7, spare main blade portions of different pitches may be stored in a boat without requiring a significant amount of storage space. The embodiment of the invention shown in FIG. 1 provides an extremely rugged arrangement that allows quick replacement of an entire blade section if one blade is damaged, or if a propeller of different pitch is required without the necessity of removing the hub from the propeller shaft. The replaceable blade sections of FIG. 1 are much more easily stored than an entire spare propeller. The cost of each of replaceable blade sections such as 5, 11, etc. is far less than the cost of a replacement single piece marine propeller of comparable performance capability.

Figure 11:
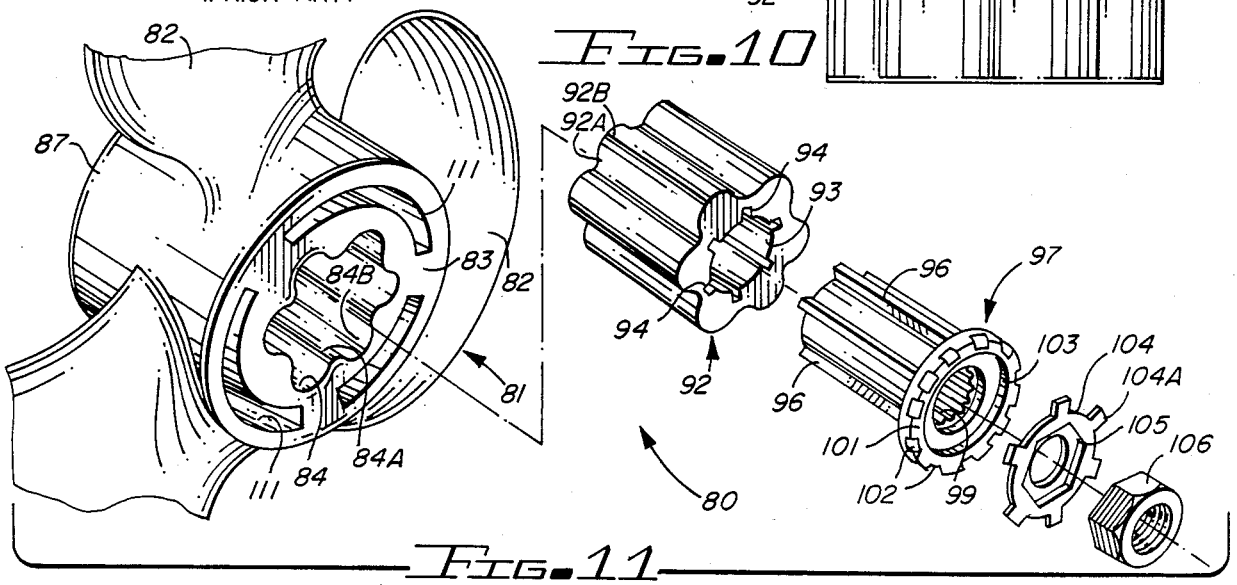
FIG. 11 is a partial perspective exploded view illustrating the shock mount coupling apparatus of the present invention.

Referring now to FIG. 11, an improved shock absorbing slip clutch assembly is shown for a marine propeller in accordance with the present invention. Reference numeral 80 designates the entire assembly in both FIGS. 11 and 12. Marine propeller 81 includes three propeller blades 82 which are integrally formed with hub 83, although separable blades and blade support bases could be provided in the manner previously shown in FIG. 1.

Figure 12:
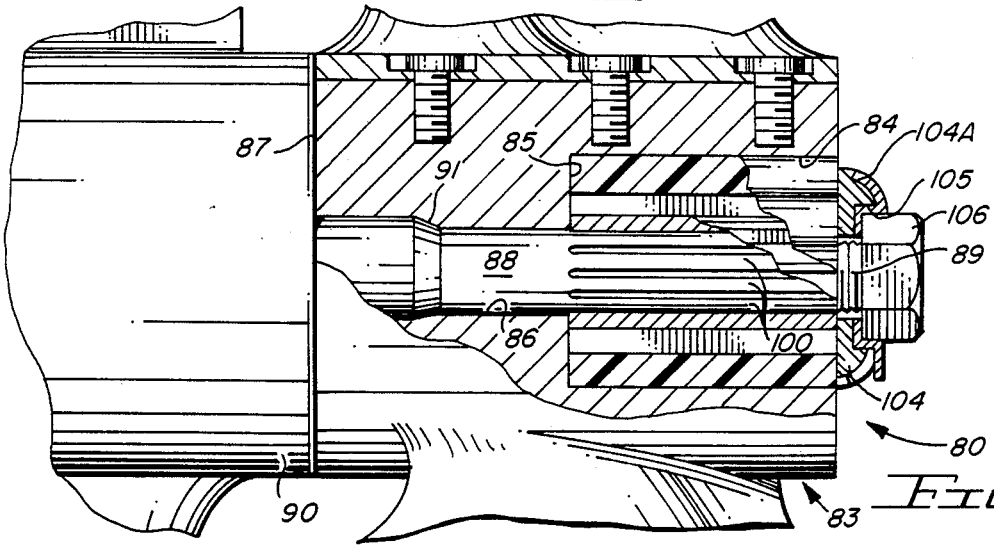
FIG. 12 is a partial cutaway view illustrating the device shown in FIG. 11 in assembled form.

A shock mount receiving hole 84 extends part-way through hub 83 as shown in FIGS. 11 and 12 and extends to its bottom surface 85 (FIG. 12). A smaller hole 86 extends from bottom 85 of hole 84 to the left end 87 of hub 83. A drive shaft 88 extends through hole 86, and has a threaded end 89 which extends beyond the mouth of hub hole 84 when propeller 1 is mounted on the trailing end of a marine out-drive unit 90. Drive shaft 88 has an enlarged shoulder portion 91 which is sealed tightly against a corresponding enlarged shoulder portion of hole 86, limiting the leftward movement of propeller 80 as it is installed on drive shaft 88.

Figure 8:
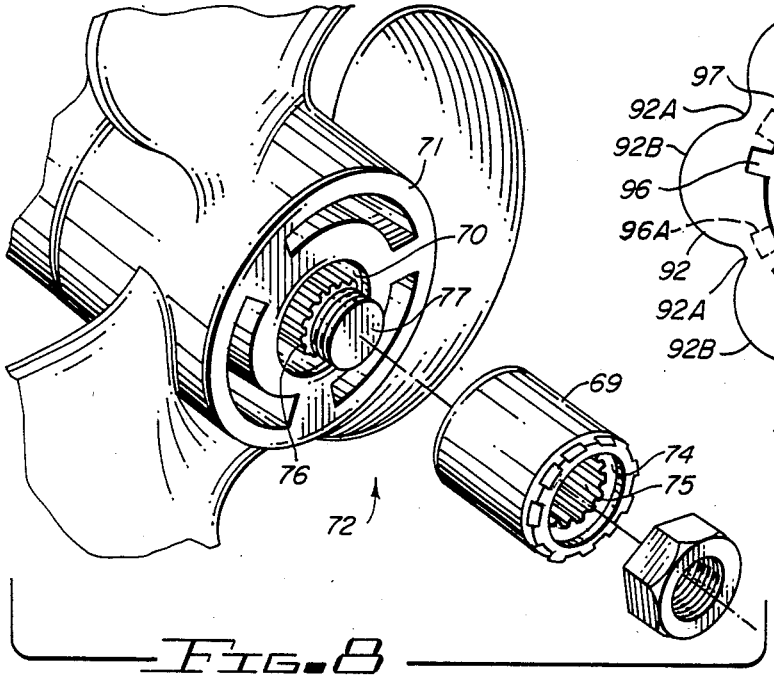
FIG. 8 (PRIOR ART)
FIG. 8 is a partial perspective exploded view illustrating a rubber shock mount apparatus of the prior art.

In accordance with the present invention, shock mount receiving hole 84 has a wavy or scalloped surface consisting of alternate peaks 84A and valleys 84B symmetrically disposed along an imaginary cylindrical surface of shock mount receiving hole 84. Thus, a cross sectional view perpendicular to the longitudinal axis of shock mount receiving hole 84 and drive shaft receiving hole 86 indicates that hole 84 has a generally rose-shaped configuration. This is to be contrasted with the cylindrical shock mount receiving hole 70 shown in the prior art marine propeller shown in FIG. 8.

Further, in accordance with the present invention, a resilient shock mount sleeve 92 has an outer surface having elongated, parallel peaks 92B and valleys 92A. Peaks 92B of resilient shock mount sleeve 92 fit precisely into valleys 84B of shock mount sleeve 92. The tolerances are such that resilient shock mount sleeve 92 can be slid into shock mount receiving hole 84 by hand, with relatively little pressure.

Figure 9:
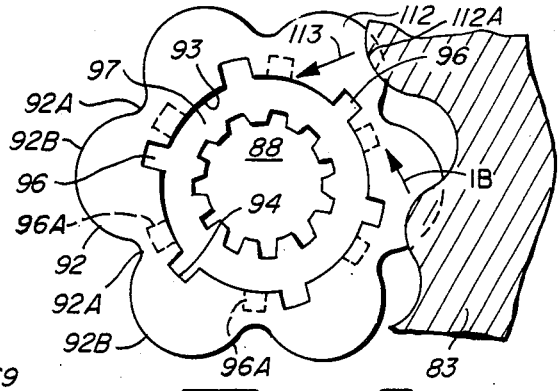
FIG. 9 is a sectional diagram useful in explaining the resilient coupling of the present invention.
Figure 10:
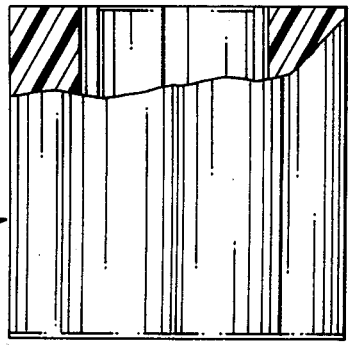
FIG. 10 is a partial cutaway elevation view of the resilient shock mount coupling sleeve included in the device illustrated in FIG. 11.

An end view of resilient shock mount sleeve 92 is shown in FIG. 9, and a partial cutaway side view thereof is shown in FIG. 10. As best seen in FIGS. 9 and 10, an axial hole 93 extends through the length of resilient shock mount sleeve 92. A plurality of rectangular keyways 94 also extend the length of shock mount sleeve 92 for receiving keys 96 of a spline driver sleeve adaptor 97. Resilient shock mount sleeve 92 can be composed of rubber or like material having, for example a durometer rating in the range from less than 40 to approximately 100. Our experiments performed up to now with 15 inch marine propellers on a boat powered with a 260 horsepower marine engine have indicated that 50 through 90 durometer rubber is satisfactory. It is clear to us that durometer ratings outside of this range can also work well.

Spline driver sleeve adaptor 97 is formed of aluminum, although stainless steel, brass, or other materials could also be used. A drive shaft receiving hole 99 extends axially through the length of spline driver sleeve adaptor 97, and has a plurality of longitudinal keyways therein for receiving the splines 100 (FIG. 12) on the right portion of drive shaft 86. A notched lip 101 having a plurality of notches 132 peripherally disposed thereon is integrally formed with the trailing end of spline driver sleeve adaptor 97. The cylindrical recess 103 in the back face of spline driver adaptor 97 receives the inner face of a tab type lock washer 104, the front face of which includes a recess 105 that is hexagonal in shape to precisely receive the walls of a hex nut 106. After hex nut 106 has been tightened on drive shaft 88, one of the tabs 104A of lock washer 104 can be bent, in the manner shown in FIG. 12, into one of the notches 102 to prevent loosening of nut 106. The longitudinal keyways 94 receive torque from the splines 100 of drive shaft 88, causing spline driver sleeve adaptor 97 to transmit torque via keys 96 of spline driver adaptor 97 and keyways 94 of resilient shock mount sleeve 92 to hub 83. The keys 96 and keyways 94 are approximately aligned with the valleys 92A of the resilient shock mount sleeve 92, so that when the spline driver sleeve adaptor 97 is rotated relative to the hub 83, a substantial amount of resilient material of the resilient shock mount sleeve 92 becomes compressed between sloped walls of the peaks 92B of the resilient shock mount sleeve 92 and the side walls of the key 96.

Reference numeral 111 designates exhaust gas passages through hub 83.

In operation, as drive shaft 88 imparts torque in the direction of arrow 112 (FIG. 9) to resilient shock mount sleeve 92, the peaks 92B of resilient shock mount sleeve 92 can move against and become compressed by the peaks 84A of hub 83, as indicated by the dotted lines 112A in FIG. 9, in the event that propeller 80 is subjected to a sudden shock, as by striking a large rock. In such a case, the momentum of the large engine and drive train continues to force drive shaft 88 to rotate. This distortion of the resilient rubber of which resilient shock mount sleeve 82 is composed very effectively absorbs shock, by compressing the shock mount sleeve 92 inwardly between the splines or keys 96 and the peaks 84A of the hub 92 in the directions indicated by arrows 113. The compression occurs against the keys 96 of spline driver adaptor 97. This ensures that there will be no breakage or slippage of the connection between spline driver 97 and resilient shock mount sleeve 92 (as occurs when hot bonding or gluing of the inner surface of hole 93 to the smooth outer surface of a spline driver is relied upon).

In accordance with the present invention, if the torque on drive shaft 88 exceeds a predetermined level, the peaks 92B of resilient shock mount sleeve 92 will be compressed enough that they will pass over the peaks 84A of hub 83 and into the next valleys 84B of hub 84, thereby performing not only a shock absorbing function, but also a clutch-slipping function. The amount of torque at which this occurs is much more controllable and less variable than is the case for the prior art shock mount shown in FIG. 8.

Differences in the torque required to cause slippage, and also differences in the shock absorbing capability can be achieved not only by using different durometer ratings, but also different depths of the shock mount receiving hole and different corresponding lengths of the resilient shock mount sleeve 92. The relative heights and widths of the peaks and valleys of the resilient shock mount sleeve 92 and the shock mount receiving holes 84 can be designed to considerably vary the shock absorbing capability in order to minimize the damage that can occur to a drive train and/or marine engine when a propeller strikes a foreign object and can also vary the torque at which clutch-slipping function occurrs.

Our tests of the above-described shock absorbing slip clutch assembly for a marine propeller have shown that it functions at least as well as the above-mentioned conventional rubber shock absorbing devices used in marine propellers to absorb shock and prevent damage to marine engines and outdrive assemblies, and is less expensive to manufacture and is more reliable. Furthermore, our shock absorbing slip clutch assembly has the great advantage that if a problem develops, the boat owner can replace the resilient shock mount sleeve by hand, without interrupting his boating activities to take the boat to a repair shop, and without having to carry a bulky spare propeller with a rubber shock absorbing device pressed into it. The present shock absorbing slip clutch assembly never suffers from a problem that frequently occurs for conventional rubber shock absorber slip clutch assemblies; that problem is that sometimes even a brand new one or only slightly used one will begin slipping too easily. Once this happens, the boat cannot apply very much power to the propeller, because the slipping will continue and the outer surface of the rubber cylindrical shock mount sleeve will lose its grip or frictional engagement with the cylindrical inner surface of the propeller hub. Furthermore, the cost of our slip clutch assembly will be lower, because there is no need to use a hydraulic press in order to force the resilient shock mount sleeve 92 into the scalloped opening of the propeller hub. Furthermore, if conditions are such that slipping does occur for a particular propeller, then further slipping can be easily avoided by simply quickly removing the propeller "on the spot", removing the present resilient shock mount sleeve, and substituting another one that is similar, except that it has a higher durometer rating.

While the invention has been described with reference to a particular embodiment thereof, those skilled in the art will be able to make various obvious modifications to the described embodiments of the invention without departing from the true spirit and scope thereof.

For example, it is not essential that the scalloped resilient shock mount sleeve 92 be in the form of a "closed" sleeve when it is being stored. It could be slit along one of its "valleys", so that it can be spread out and stored flat; then, just prior to insertion of the spline driver sleeve adapter 97 into shock mount receiving hole 84, this flexible, scalloped shock mount "sleeve" 92 could be wrapped around the spline driver sleeve adapter 97. A more extreme variation on the device would be to provide the "peaks" 92B as individual, unconnected "key-lobes" which are inserted between suitable splines on spline driver adapter 97 just before it is slid into shock mount receiving hole 84 in the propeller hub. A very useful variation of the embodiment of the invention shown in the drawings is to offset the spline receiving key ways 94, as indicated by dotted lines 94A in FIG. 9.

We claim:

1. A marine propeller comprising in combination:

(a) a hub having therein an insert-receiving recess that is coaxial with the hub, the insert-receiving recess having a predetermined depth and a uniform, generally rose-shaped cross-sectional shape, with alternating longitudinal peaks and valleys on the inner wall extending from an open end of the insert-receiving recess to a bottom surface of the insert-receiving recess;

(b) a resilient insert disposed in the insert-receiving recess and having a predetermined length that is approximately equal to the predetermined depth of the insert-receiving recess, and having a uniform, generally rose-shaped cross-sectional shape with alternate longitudinal peaks and valleys that extend for the length of the resilient insert, the peaks of the insert extending into and mating closely with the valleys of the insert-receiving recess and the peaks of the insert-receiving recess extending into and mating closely with the valleys of the insert, the insert including an axial, cylindrical hole therein and a plurality of spaced longitudinal keyways in the surface of the cylindrical hole; and (c) means for transmitting torque from a driveshaft to the resilient insert by means of the keyways thereof, the torque transmitting means including a plurality of elongated, longitudinal splines extending into the respective keyways, each of the elongated keys being approximately aligned with a respective valley of the resilient insert to provide a substantial amount of mass of the resilient insert located between sloped walls of each of the peaks of the insert-receiving means and a side wall of a respective one of the splines in order to allow a substantial amount of compression of, and hence shock absorbing capability in that mass of the resilient insert.

2. The marine propeller of claim 1 wherein the resilient insert fits sufficiently loosely into the insert-receiving hole to the easily inserted therein and removed therefrom by hand.

3. The marine propeller of claim 2 wherein the torque transmitting means includes a rigid splined sleeve having a longitudinally splined inner surface that engages the driveshaft and a splined outer surface having the plurality of elongated longitudinal splines attached thereto, wherein the elongated longitudinal splines fit sufficiently loosely into the longitudinal keyways to allow the splined sleeve to be easily inserted by hand all the way into the cylindrical hole of the resilient insert.

4. The marine propeller of claim 3 wherein the hub has a plurality of exhaust passages therethrough located between the insert-receiving recess and an outer surface of the hub.

5. The marine propeller of claim 3 wherein the resilient insert is composed of resilient material having a durometer value in the range from 40 to 100.

6. The shock mount coupling device of claim 1 wherein said hub includes a plurality of uniformly spaced spoke members integral with and extending substantially radially outwardly from a central portion of said hub, each of said spoke members having an outer surface and a plurality of spaced threaded holes therein, said shock mount coupling device further including:

a plurality of substantially identical single blade units each including a blade support base and a propeller blade attached to that blade support base, each of said blade support bases including a substantially semi-cylindrical member having an inner lip located along one edge thereof with an inner surface abutting a respective one of said outer surfaces of one of said spoke members, said semi-cylindrical member also having an outer lip located along an opposite edge of that semi-cylindrical member for overlapping and abutting an outer surface of the inner lip of an adjacent one of said semi-cylindrical members, each of said inner lips and the outer lip overlapping that inner lip having therethrough a plurality of clearance holes aligned with the respective ones of said threaded holes in the outer surface of the spoke member abutting the inner surface of that inner lip; and a plurality of screws extending through respective ones of said aligned clearance holes and engaging the threads of corresponding ones of said threaded holes to tightly attach said edges of each of said blade support bases to said outer surfaces of two adjacent ones of said spoke members, respectively, said spoke members being sufficiently thick and rigid to allow said screws and said threads of said threaded holes to be large enough and strong enough to avoid being damaged when any of said propeller blades strikes a large, hard obstacle at such high speeds that the propeller blade is at least partially sheared off, whereby individual ones of said single blade units that are severely damaged as a result of encountering large, objects at high speeds can be repeatedly replaced because no resulting damage to said hub occurs.

7. The marine propeller of claim 4 wherein the insert-receiving recess extends only part way through the axial length of the hub, a hole of reduced diameter extending coaxially with the insert-receiving recess from the bottom surface of the insert-receiving recess to an inner end of the hub for receiving an unsplined portion of the driveshaft.

8. The main propeller of claim 1 wherein the slopes of the peaks and valleys of the resilient insert vary smoothly and non-abruptly.

* * * * *